United States Patent [19]

Kryzanowsky

[11] 4,227,436

[45] Oct. 14, 1980

[54] MUSICAL INSTRUMENT KEYBOARD

[76] Inventor: Dmytro M. Kryzanowsky, 32-85 37th St., Long Island City, N.Y. 11103

[21] Appl. No.: 525,370

[22] Filed: Nov. 20, 1974

[51] Int. Cl.[3] ..... G10C 3/12

[52] U.S. Cl. ..... 84/423 A

[58] Field of Search ..... 84/423, 424, 427, 428, 84/451

[56] References Cited

U.S. PATENT DOCUMENTS

| | | | |
|---|---|---|---|
| 281,898 | 7/1883 | McChesney | 84/427 |
| 334,484 | 1/1886 | Stewart | 84/428 |
| 1,680,582 | 8/1928 | Zidell | 84/423 |
| 1,958,227 | 5/1934 | Barnett | 84/423 |
| 2,417,639 | 3/1947 | Firestone | 84/428 |
| 2,611,291 | 9/1952 | Heim | 84/451 X |

FOREIGN PATENT DOCUMENTS

| | | | |
|---|---|---|---|
| 3404 | of 1811 | United Kingdom | 84/428 |

*Primary Examiner*—Lawrence R. Franklin
*Attorney, Agent, or Firm*—Hubbell, Cohen, Stiefel & Gross

[57] ABSTRACT

A novel keyboard for use on pianos, organs and the like comprising two confronting sets of keys, each key having a widened main part and a narrow extension, the two sets of keys being arranged with their main parts in confronting relation and with their extensions interleaved therebetween.

2 Claims, 2 Drawing Figures

MUSICAL INSTRUMENT KEYBOARD

BACKGROUND OF THE INVENTION

1. Field of the Invention

This invention pertains to a novel keyboard for use on pianos, organs and the like.

2. Statement of the Prior Art

The ordinary keyboard consists of white and black keys on two different levels, the black keys being arranged in an asymmetric series of two and three keys per octave over the entire keyboard, each octave containing five black keys and seven white keys representing the twelve fundamental tones. When arranged in ascending order according to frequency, each alternate tone is referred to as a whole tone with the tones in between denominated as the half tones. In a conventional keyboard, the lower keys are not limited to whole tones. This is apparent from the fact that there are seven lower white keys and five upper black keys in each octave on a conventional keyboard. This asymmetrical arrangement unnecessarily complicates play.

SUMMARY OF THE INVENTION

According to the invention I have developed a novel keyboard intended to simplify learning and play of instruments such as pianos, organs and the like. The preferred keyboard includes two sets of keys, each key having a widened main part and a narrow extension, the extensions in one of the sets of keys being raised relative to their corresponding widened parts. The two sets of keys are arranged in confronting relation such that their extensions are interleaved. As such, the novel keyboard defines essentially three rows of keys, an upper row comprising the widened parts of one set of keys, a lower row comprising the widened parts of the other set of keys, and a third row comprising the interleaved extensions of all the keys.

The keys are connected to the tone producing means of the instrument such that juxtaposed widened parts in the upper and lower rows are in a whole tone relation, it therefore being apparent that juxtaposed extensions in the third row of keys are in a half tone relation. Accordingly, it will be apparent that the keyboard of the invention provides a symmetrical arrangement with respect to the tones, and it is expected that this symmetry will simplify learning and play. Moreover, except for alternate extensions, the upper surface of the keyboard lies in one plane, thereby simplifying fingering transitions.

Further features and advantages of the present invention will be more fully apparent from the following detailed description and annexed drawings of the preferred embodiment thereof.

DETAILED DESCRIPTION OF THE PREFERRED EMBODIMENTS

Figure 1:
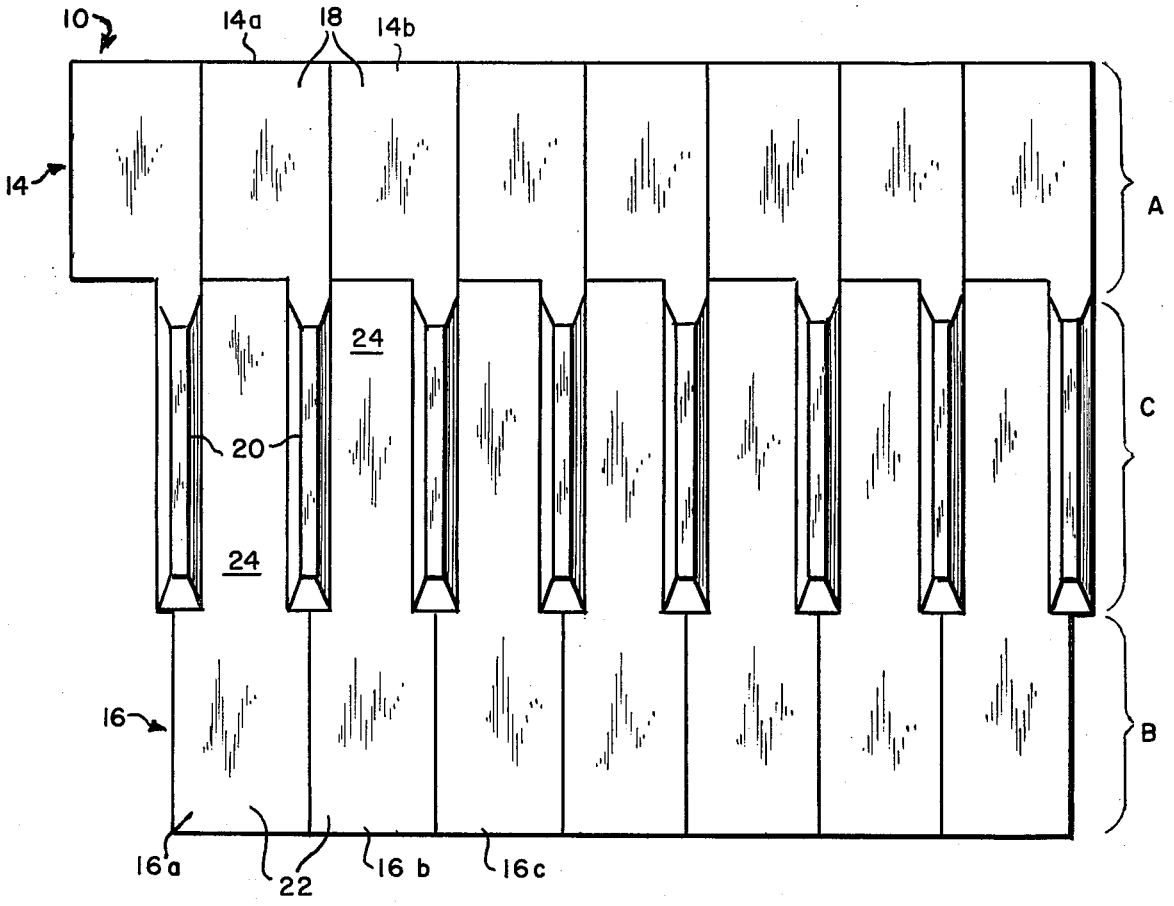
FIG. 1 is a top plan view of a keyboard in accordance with the present invention.
Figure 2:
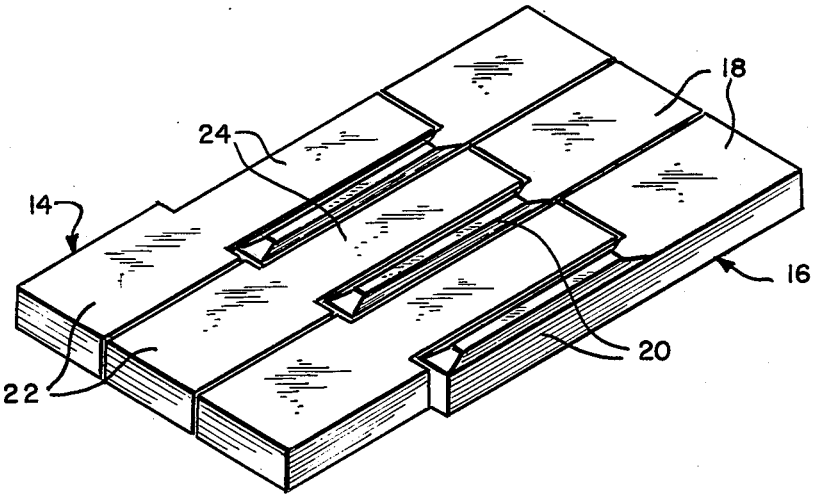
FIG. 2 is a fragmentary perspective view of the keyboard shown in FIG. 1.

Referring now to the drawings, 10 designates the preferred novel keyboard according to the present invention. As shown, the keyboard 10 comprises two sets of interleaved keys, an upper set of keys 14 and a lower set of keys 16. Each key 14 in the upper set includes a widened part 18 and a narrow extension 20, the extension 20 being raised relative to the part 18. Each of the keys 16 in the lower set also includes a widened part 22 and an extension 24. Unlike the keys 14, the upper surfaces of the extensions 24 are not raised relative to the parts 22. Also, as presently preferred and shown, the extensions 24 are somewhat wider than the extensions 22. It will thus be apparent that the keyboard 10 provides essentially three rows of keys, a first row A comprising the widened parts 18 of the upper set of keys 14, a second row B comprising the widened parts 22 of the lower set of keys 16, and a third row C comprising the interleaved extensions 20 and 24 of the keys 14 and 16, respectively.

According to the invention, there is a whole tone relation between adjacent keys in the rows A and B of the keyboard 10. That is, assuming that the key **16*a* is connected to tone producing means for the note C, the key 14*a* would be connected to tone producing means for the note C#, the key 16*b* to tone producing means for the note D, the key 14*b* to tone producing means for note D#, the key 16*c*** to tone producing means for the note E, etc. Accordingly, the relationship between adjacent extensions in the interleaved portions of the keyboard, row C, is that of half tones.

Play on the keyboard 10 is greatly simplified. This is due, in part, to the fact that the tonal relationship between adjacent keys in each of the three rows A, B, C of the keyboard 10 is the same. That is, in the first rows of keys A, the relationship between adjacent keys it that of whole tones. The same is true of the relationship between adjacent keys in the row B. In row C, the relationship between adjacent keys is that of half tones. It is anticipated that this symmetry will greatly facilitate learning and play. Furthermore, except for the extensions 20, the upper surfaces of the keys 16 and 18 lie in a common plane. As a result, finger transitions between the various rows of keys is simplified. The extensions 20 are elevated to readily distinguish between adjacent half tones in the C row of keys. If desired, the keys may be color coded to further simplify learning and play.

While I have herein shown and described the preferred embodiments of the present invention and have suggested certain modifications thereto, it will be apparent that further changes and modifications may be made without departing from the spirit and scope of the invention. Accordingly, the above description should be construed as illustrative and not in the limiting sense, the scope of the invention being defined by the following claims.

I claim:

1. In a keyboard for a musical instrument of the type including a plurality of keys adapted for connection to means for producing the twelve fundamental tones in an octave, each key corresponding to a different one of said tones, said keyboard being of the type including a plurality of keys having upper surfaces for manipulating said keys to activate said tone producing means, the improvement comprising:

said keys being arranged in two confronting rows, each key having a main part and an extension, said rows being arranged with said main parts on opposite sides of said keyboard with their upper surfaces in a common plane with said extensions interleaved therebetween, the upper surfaces of the extensions in one of the rows of keys being raised relative to the upper surfaces of the extensions in the other row of keys which lie in said plane, whereby said keys may be connected to said tone producing means with the extensions of said keys corresponding to continuously increasing tones from one end of said keyboard to the other.

2. The keyboard according to claim 1, wherein the adjacent main parts of said one row of keys and adjacent main parts of said other row of keys are in a whole tone relation to each other whereby adjacent interleaved extensions are in a half tone relation to each other.

* * * * *